US005788541A

United States Patent [19]

Lueder

[11] Patent Number: 5,788,541

[45] Date of Patent: Aug. 4, 1998

[54] ELBOW LUG

[76] Inventor: Lawrence A. Lueder, 698 Bridgeton Pike, Mantua, N.J. 08051

[21] Appl. No.: 801,968

[22] Filed: Feb. 18, 1997

[51] Int. Cl.[6] ..... H01R 4/36

[52] U.S. Cl. ..... 439/814; 439/810

[58] Field of Search ..... 439/801, 810, 439/814, 790, 791, 727, 805, 813

[56] References Cited

U.S. PATENT DOCUMENTS

| | | | |
|---|---|---|---|
| 2,083,923 | 6/1937 | Rowe | 439/814 OR |
| 3,609,657 | 9/1971 | Stanback | 439/814 OR |
| 3,998,520 | 12/1976 | Zemels | 439/814 OR |
| 4,214,806 | 7/1980 | Kraft | 439/814 X |

*Primary Examiner*—P. Austin Bradley
*Assistant Examiner*—Daniel Wittels

[57] ABSTRACT

An electrical box wiring termination lug to ease installation of thick wires into tight areas within these boxes. An elbow lug similar in appearance and function to a plumbing elbow.

2 Claims, 7 Drawing Sheets

ELBOW LUG

BACKGROUND OF THE INVENTION

This invention relates to heavy gage wire lugs especially those used for electrical service entry wire. 2/0 size and thicker.

Standard size 100 to 200 Amp service entry boxes in most homes in America are typically wired with either 2/0 to 4/0 aluminum service wiring. In some cases this wiring can be difficult to bend to engage properly with the boxes main breaker. Bending such thick wiring causes stresses on the main breaker that can under certain circumstances cause it to fracture.

BRIEF SUMMARY OF THE INVENTION

This invention is directed to a special lug that's designed to function like a plumbing elbow in that it redirects the current flow in sharp corners. It is designed to fit into the main breaker's service wiring connections/clamps. Once attached, service wiring installation in the box is eased and bending stresses are minimized.

DETAILED DESCRIPTION OF THE INVENTION

Figure 1:
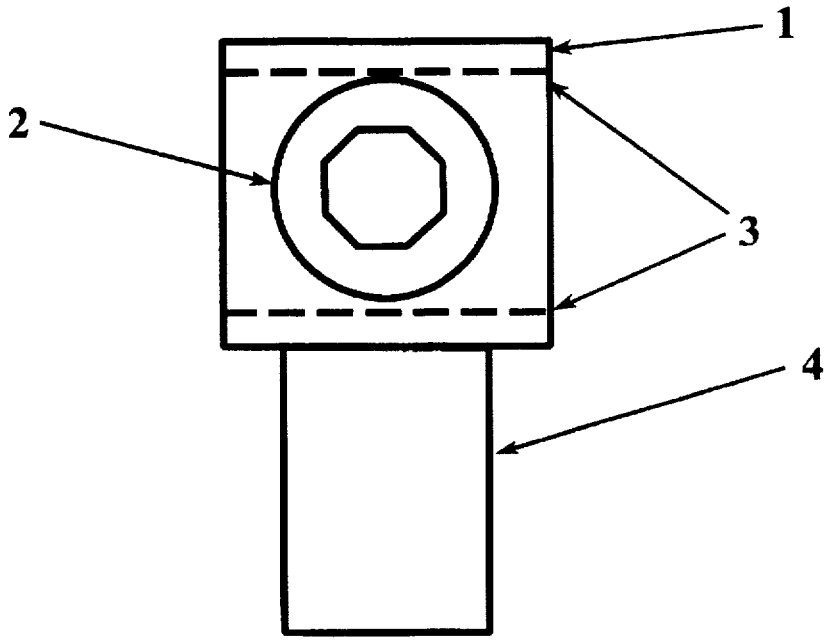
FIG. 1 is a top view of the elbow lug.

Referring to FIG. 1, an elbow lug 1. is shown, rectangular in shape with a hole 3 to receive the service wiring. The hole 3 is perpendicular to it's mounting shaft 4. Service wiring is secured to the elbow lug 1 using a set screw 2 which is threaded/installed perpendicular and centered to the service wiring hole 3.

Figure 2:
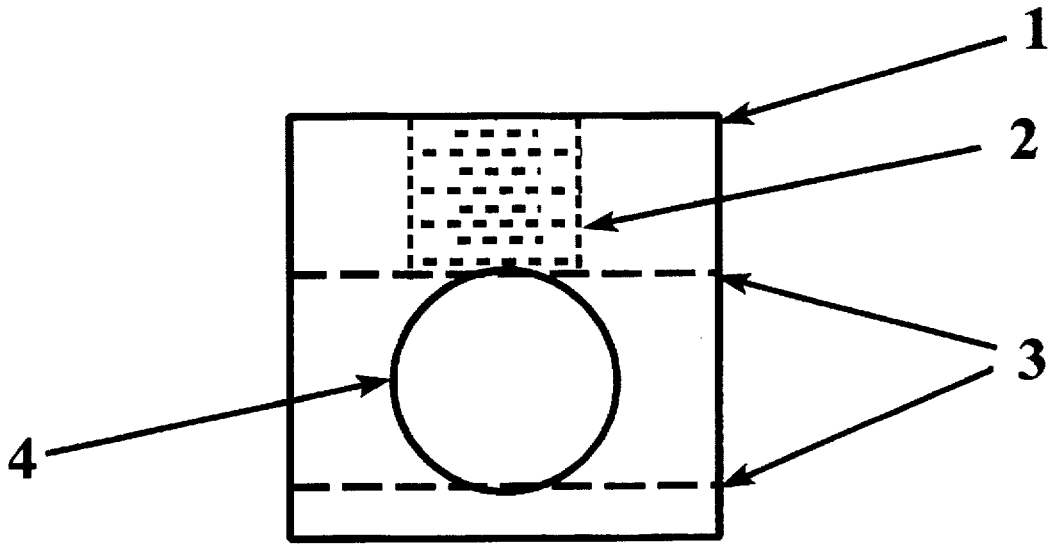
FIG. 2 is an end view of FIG. 1.

FIG. 2 illustrates the mounting shaft 4 in relation to the service wiring hole 3. The shaft 4 is centered and it's diameter is of maximum allowable diameter to allow easy insertion and removal into the main breaker. A shallow flat surface (not shown) can be added to the shaft diameter to insure the elbow lug 1 doesn't rotate or come lose once installed. The main body may be of any suitable form provided it secures service entrance type wiring to a ninety degree securing support. The securing set screw 2 can be one or a plurality thereof.

Figure 3:
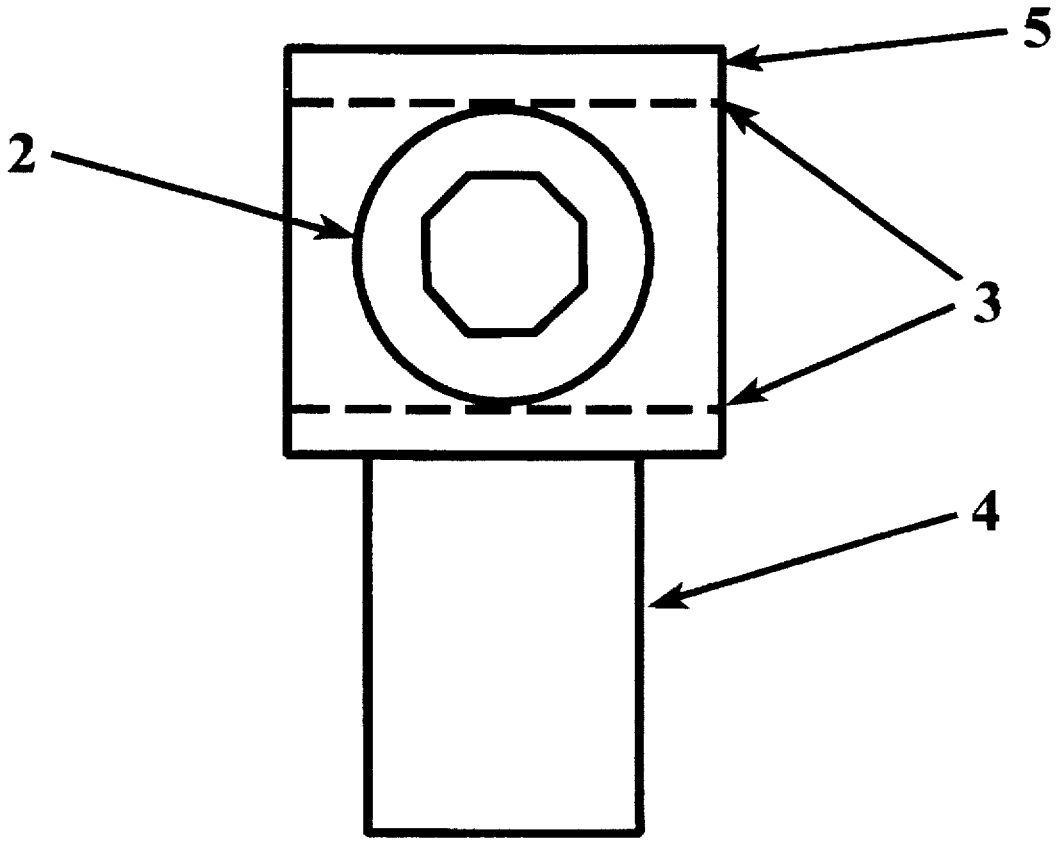
FIG. 3 is a top view of an elbow offset lug.
Figure 4:
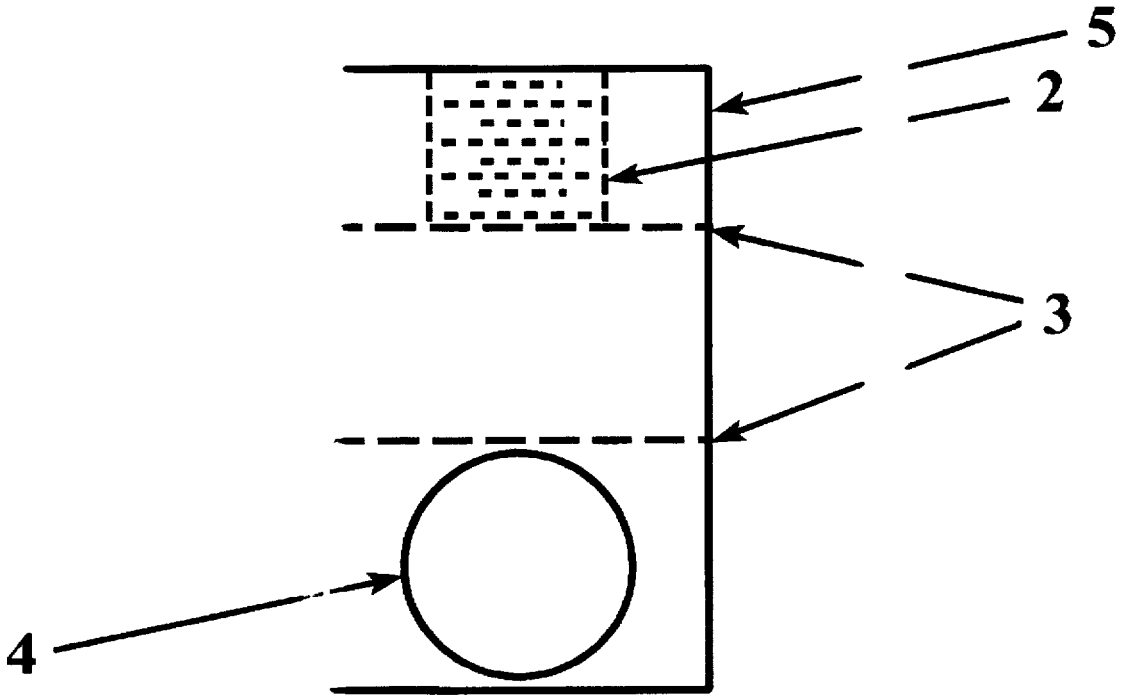
FIG. 4 is an end view of FIG.3.

FIG. 3 is an elbow offset lug 5 which is identical in appearance and function as elbow lug 1 in FIG. 1 with exceptions. FIG. 4 is an end view of FIG. 3 showing the exception, an offset service wiring hole 3. The other noticeable difference between FIG. 1 and FIG. 4 is that FIG.4 shows the additional height of the rectangular area to offset the wiring when installed in the service box. Dimensions, material, insulation, etc. of the elbows per manufacture preference.

Figure 6:
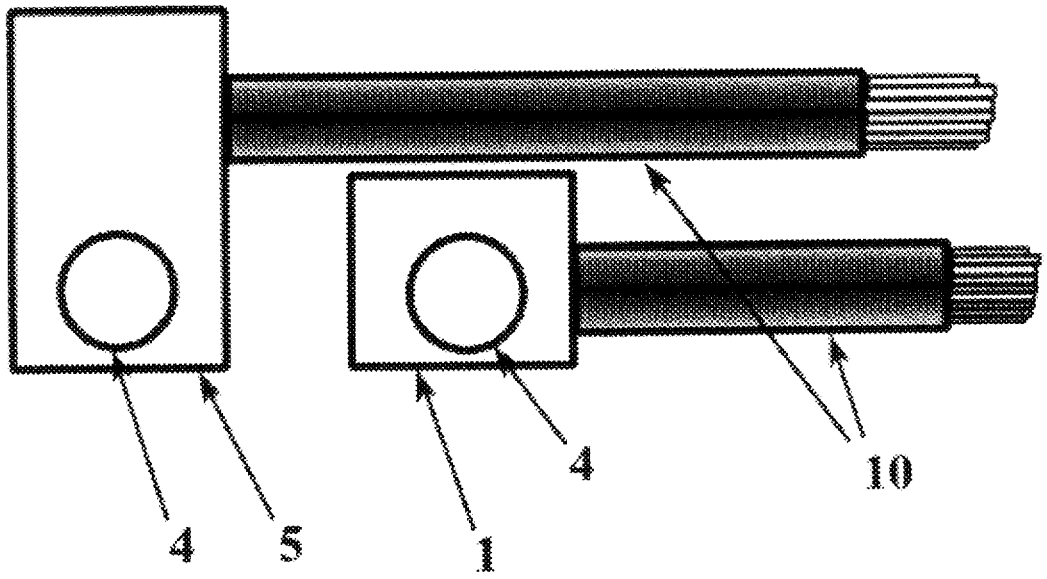
FIG. 6 is an end view of FIG.5.
Figure 5:
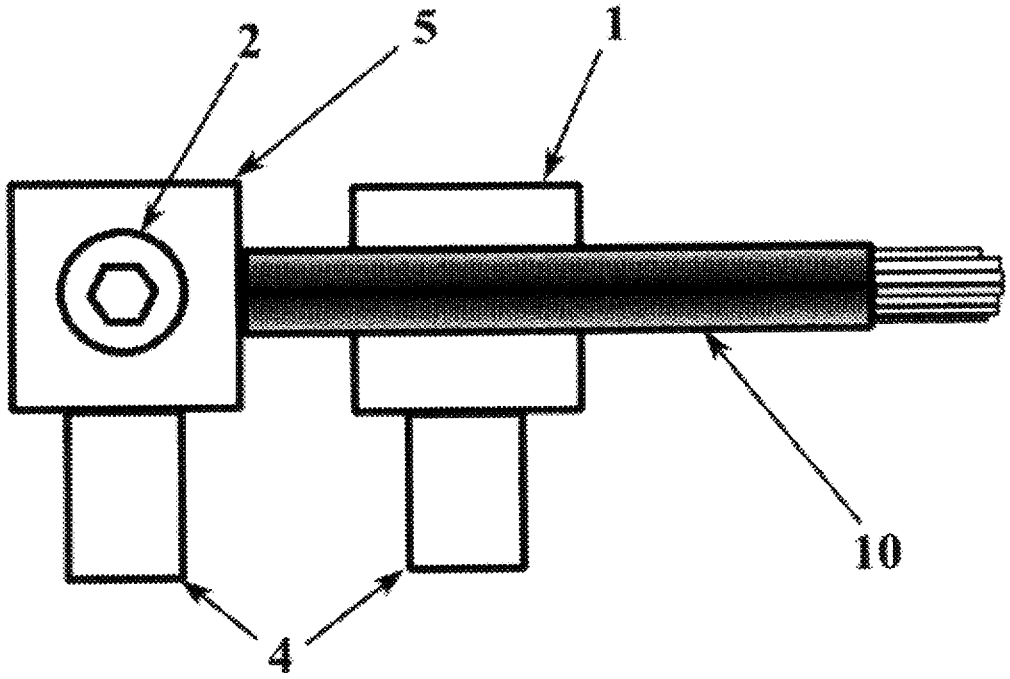
FIG. 5 is a top view showing the elbow and elbow offset lugs wired.

FIG. 5 is a plan view showing both elbow lugs 1 and 5 as they might appear and function with wiring 10 installed. The view shows how the elbow offset lug 5 allows for ample clearance for elbow lug 1 with wiring underneath. FIG. 6 is an end view of FIG.5 and better illustrates the wiring clearance.

Figures 7, 8:
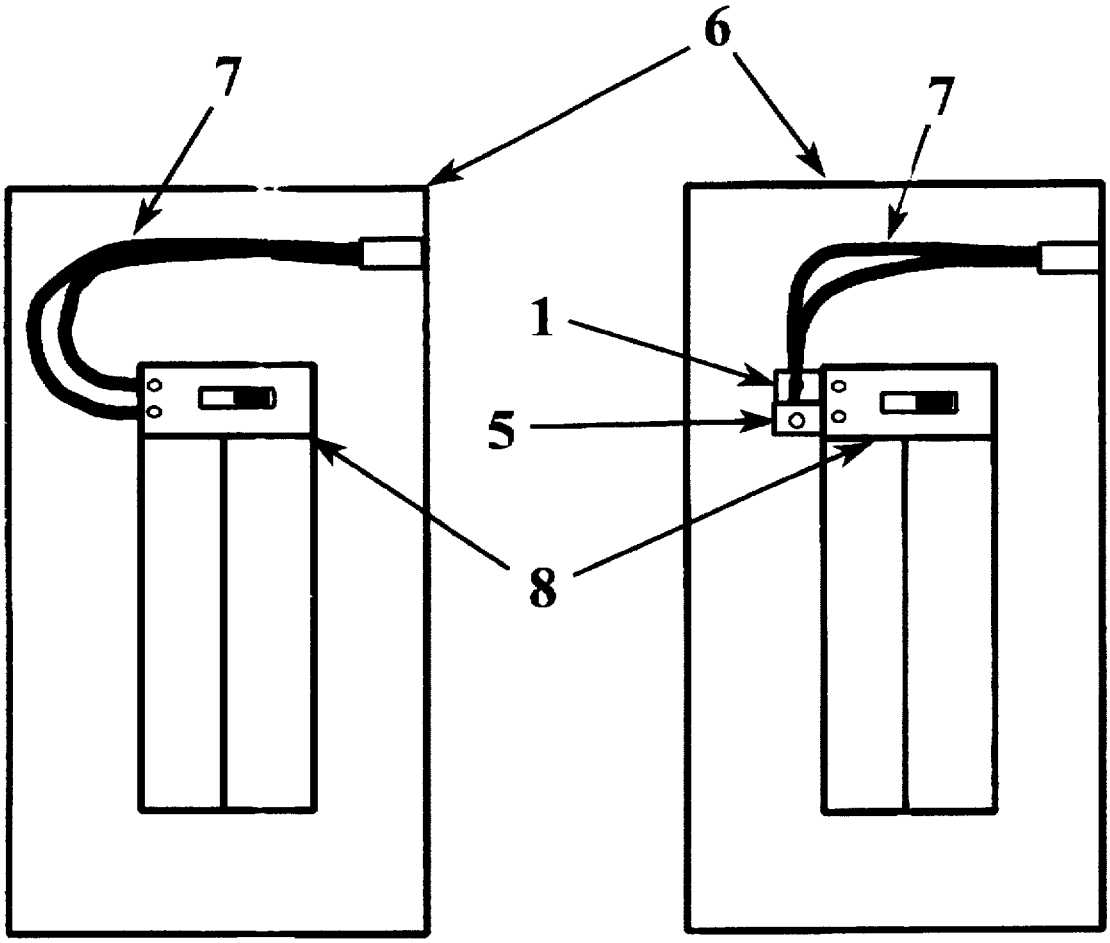
FIG. 7 is a view of a typical electric service entrance box with cover panel removed.
FIG. 8 is a view of a typical electric service entrance box with cover panel removed showing elbow offset lugs installed.

FIG. 7 and FIG. 8 illustrates two residential service entrance boxes 6 with main breaker 8. The boxes 6 have their covers removed to show the service entrance wiring 7 connected to the breakers 8. FIG. 8 service box is wired with elbow lug 1 and elbow offset lug 5 and FIG.7 is without elbow lugs. The service entrance box with elbows lugs FIG. 8 is clearly under less bending stress. Installing 4/0 size wiring becomes much easier with elbow lugs.

Figure 9:
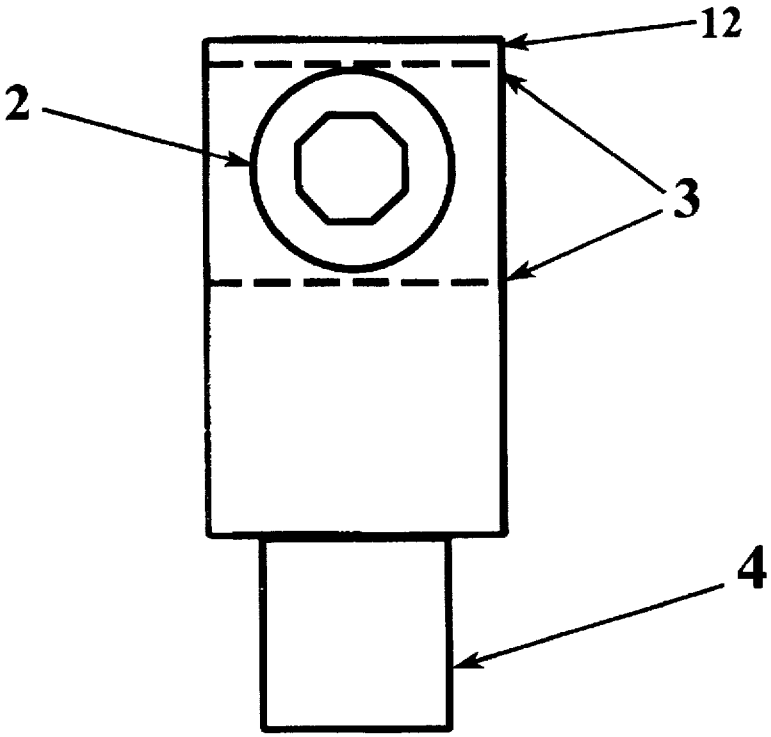
FIG. 9 is a top view of an elbow extended lug.

FIG. 9 is another extend elbow lug 12 form similar to FIG. 1 with the exception of the body being longer. The additional length allows the service entrance wires to clear each other with side to side clearance.

Figure 10:
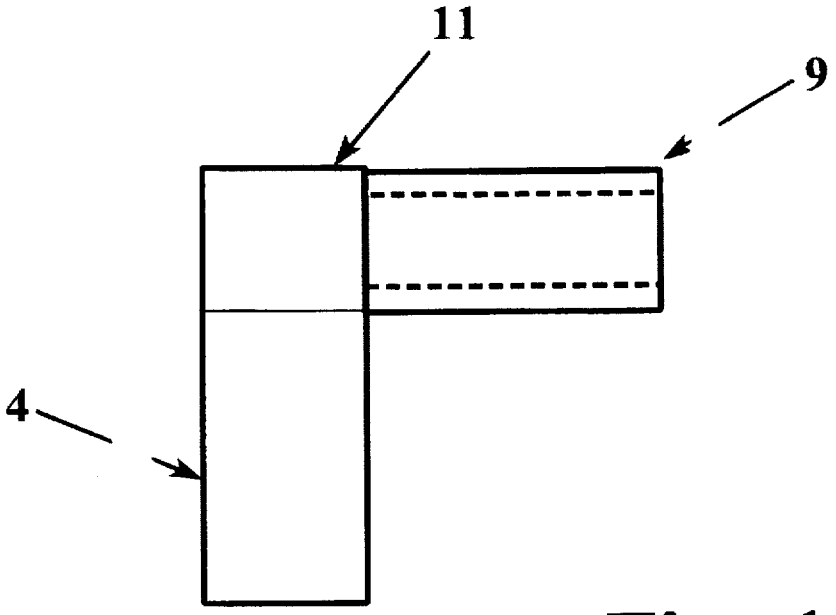
FIG. 10 is a top view of an elbow crimp lug.

FIG. 10 is a crimp elbow lug 11 variation to FIG. 1 with wire crimping/compression capabilities 9 verses a set screw or screws to secure the wiring. The offset hole and longer mounting shaft also apply, but are not shown. The crimp elbow lug 11 is reliable for termination of an aluminum conductor in mechanical connections. The plug can have the same diameter as a current carrying equivalent copper wire. Should this lug be used as a termination for aluminum wiring it can be prefilled with a anti-corrosion joint compound such as PENROX™. All elbows are UL listed to 600 volts and can also be supplied with insulating rubber covers, also not shown.

Figures 11, 12:
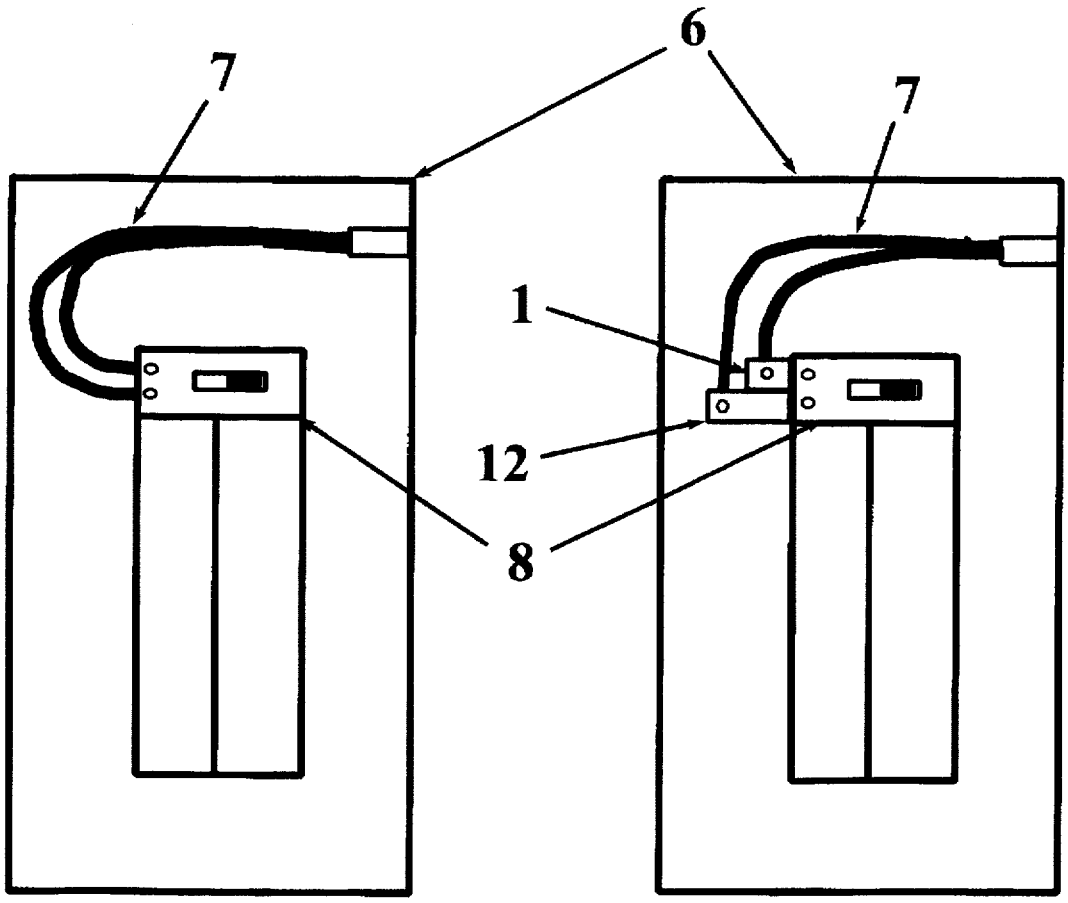
FIG. 11 is a view of a typical electric service entrance box with cover panel removed.
FIG. 12 is a view of a typical electric service entrance box with cover panel removed showing elbow extended installed.

FIG. 11 and FIG. 12 illustrates as does FIG. 7 and FIG. 8, the different panel box wiring techniques. FIG. 12 shows the long body extend elbow lug 12 verses conventional wiring methods. The entrance wires lay side by side verses one wire on top the other.

While there has been shown and described a preferred embodiment of the elbow lug of this invention, it is understood that changes in structure, material, sizes, and shape can be made by those skilled in the art without departing from the invention. The invention is defined in the following claim.

I claim:

1. An electrical elbow lug to ease service entrance wiring and installation in main circuit breakers, switches, fuses and electrical equipment in service load center and distribution boxes for fastening said wiring with perpendicular bends relative to a fixed member, comprising:

a solid rectangular block assembly with a wiring hole to fasten and secure wiring perpendicular and centered relative to the solid rectangular block assembly, a circular mounting plug which has a diameter equivalent to the wiring hole, and is attached to an end of the rectangular block assembly so as to be perpendicular to the wiring hole, a set screw centered in the rectangular block body to secure a wire in the hole, and a flat surface on said mounting plug to prevent elbow lug rotation, and an insulating skin to cover exterior services of said elbow lug.

2. An electrical elbow lug as in claim 1 with an offset block body between the solid rectangular block assembly and the circular mounting plug whereby the wiring hole is offset.

* * * * *